US005713080A

United States Patent [19]

Tate

[11] Patent Number: 5,713,080

[45] Date of Patent: Feb. 3, 1998

[54] CLOTHING ORNAMENTATION DEVICE

[76] Inventor: Gloria A. Tate, 4719 S. Logan, Englewood, Colo. 80110

[21] Appl. No.: 753,177

[22] Filed: Nov. 20, 1996

[51] Int. Cl.[6] ..... A41D 27/08

[52] U.S. Cl. ..... 2/244; 2/1; 63/2; 63/1.11

[58] Field of Search ..... 2/244, 271–336, 2/338, 341; D2/762, 767, 739, 741, 792, 795, 600, 602, 609; 63/1.11, 2, 20, 21; 428/7

[56] References Cited

U.S. PATENT DOCUMENTS

| | | | |
|---|---|---|---|
| 789,234 | 5/1905 | Rice . | |
| 910,340 | 1/1909 | Wittstein . | |
| 3,208,238 | 9/1965 | Spizer . | |
| 4,143,422 | 3/1979 | Wilson . | |
| 4,718,252 | 1/1988 | Fossas . | |
| 4,763,489 | 8/1988 | Strong | 63/20 X |
| 4,885,805 | 12/1989 | Mason | 2/224 |
| 5,513,391 | 5/1996 | Douglas et al. | 2/207 |

FOREIGN PATENT DOCUMENTS

| | | | |
|---|---|---|---|
| 591570 | 4/1925 | France . | |
| 3448 | of 1890 | United Kingdom . | |
| 16251 | of 1908 | United Kingdom . | |
| 1137737 | 12/1968 | United Kingdom | 63/2 |

*Primary Examiner*—C. D. Crowder
*Assistant Examiner*—Shirra L. Jenkins
*Attorney, Agent, or Firm*—Ramon L. Pizarro; Edwin H. Crabtree

[57] ABSTRACT

A clothing ornamentation device and method for decorating the upper torso area of an individual wearing a garment. The device includes a securement element that attaches to the upper back portion of a wearer's garment and allows the attachment and support of strands and ornaments to the strands. The weight of the ornaments produces a bias on the strands, so that the ornamentation may be draped over the user's upper chest area, where they will rest while being supported by the strands. The device allows variation of number and composition of the ornaments as well as the strands. The device attaches to back portion of wearer's garment near the neck area of the garment. This allows the draping or incorporation of ornaments that may be used to decorate the back of the user's garment as well.

11 Claims, 2 Drawing Sheets

CLOTHING ORNAMENTATION DEVICE

BACKGROUND OF THE INVENTION (a) Field of the Invention

This invention generally relates to a method and a device for decorating the area around the chest and neck, and more particularly, but not by way of limitation, to a decorative device for suspending ornaments about the neck area and draping over the chest area in order to give the appearance of a double pendant, open necklace, ornamental hair extensions or long earrings and for bringing attention to the area of the chest, neck, and head of the wearer.

(b) Discussion of Known Prior Art

Historically, people have enjoyed placing ornamentation around the neck and chest area. Most of the known ornaments have encompassed embodiments such as necklaces, ties, and bolo ties, which completely surround the neck and thus draw attention to the wearer's head and face. An example of such a device is taught in U.S. Pat. No. 4,143,422 to Wilson, which teaches the use of an ornamental member together with a clasp that reaches over the seam of the wearer's collar. The Wilson device is particularly useful for draping a string of beads down along the front of the wearer's shirt.

Yet another approach at decorating the upper torso area of a wearer is taught in U.S. Pat. No. 4,718,252 to Fossas. The Fossas device provides a wearer with an ornamental necklace which incorporates a balancing means for keeping the necklace properly centered over the wearer's shoulder's. To achieve this result, the Fossas device includes a pair of arcuate shoulder rests and a air of balance weighted ornaments between the two shoulder rests. Thus, it is clear that while the Fossas device provides a solution to problems associated with the exertion of pressure directly on the neck of the wearer, it approaches the problem of how to ornament and draw attention to the wearer's head and face in much the same manner as the well known necklace, by surrounding the neck and head.

For the sake of appearance it is highly desirable to have an ornament which decorates both sides of the wearer's body equally. Thus devices such as the neck chain taught in U.S. Pat. No. 910,340 to Wittstein incorporate clasps that allow the complete surrounding of the wearer's neck and maintain this position by attaching directly to the back of the wearer's clothing.

Ornaments which are designed for draping about the wearer's neck and chest include long furs and scarves. However, items such as the scarf, which performs the function of keeping the wearer's neck and chest warm and serves as an ornament for combining with clothes, are typically wrapped completely around the wearer's neck when in use and are not secured to the clothing or neck in any way. Thus, these kinds of devices can drift about the wearer's neck area.

It is known that it is advantageous to decorate a person's neck and shoulder area. However, most of the known devices for decorating a person's neck and shoulder area include some sort of means for ensuring that the ornament is wrapped completely around the wearer's neck. Also, it is known that another way to decorate the upper torso area, in order to draw attention to the wearer's head and face area, is by wearing earrings with ornamentation. Still other methods of drawing attention to the upper torso, and particularly the head and face, is the use of necklaces, pins or the use of beads and the like in the wearer's hair. Still yet another manner for drawing attention to the wearer's head and face is to weave in to the person's hair a braided hair extension that incorporates beads and the like.

Thus, with a variety of different ornaments and devices a person may draw attention to the wearer's upper torso, and particularly to the person's head and face. However, it is rather time consuming to have to put these items on and make sure that they all match and are secure.

There remains a need for device that can achieve the effect of several items of jewelry and ornamentation in order to draw attention to the wearer's upper torso, and particularly to the wearer's head and face area.

Moreover, there remains a need for an ornament device that can be worn about the neck and upper shoulder area and is comfortable, secure and unobtrusive to the user.

There remains a need for a clothing ornamentation device that allows the wearer to decorate the front, upper torso area of their body, while also providing means for supporting decorations that may be seen while worn over the wearer's back.

Still further, necklaces and the like must be of a length that leaves room around the wearer's neck, and, therefore, must be sold to match the wearer's body size. Thus there remains a need for a device that can fit and compliment wearer's of different body sizes.

SUMMARY

It has been discovered that the problems and needs left unsolved by the known prior art can be met by providing a device for decorating the upper torso area of an individual wearing a garment, the device includes at least the following elements:

a) securement means for attaching to the device to the wearer's garment;

b) a strand having a first and a second portion, each strand portion being of a weight, the strand being attachable to the means for attaching the device to the wearer's garment;

c) ornaments of a weight that will add to the weight of each portion of the strand, so that the ornaments may be draped and supported over the user's upper chest area while being supported by the portions of the strand.

By combining the above elements it has been discovered that new, useful, and unexpected results can be achieved. More specifically, the clothing ornamentation device taught here allows the wearer to use a basic attachment element, or securement means for attaching the device to the wearer's garment, and a pair of sections of strands to support a variety of pendants or ornaments over the wearer's chest or upper torso area. The pair, or sections, of strands should be generally light weight. This allows the user to place ornaments on or near the ends of the sections of strands, in order to support these ornaments over the chest area of the wearer. It should be understood that the added weight of the ornament will bias the assembly of the ornaments and the strands, so that the ornament or pendants will rest over the chest area, and particularly rest over the upper pectoral muscles and near the shoulder muscles of the wearer, without having a tendency to swing or be pulled back over the shoulders of the wearer.

Thus it should be clearly understood that the expression "weight" as used herein refers to what is commonly known as the product of the mass of the object times the acceleration of gravity, and not to an object that is used as a load.

Moreover, by allowing the pendants to drape over the shoulder and on to the chest area one can achieve an ornamentation that appears and drapes like earrings, and also makes a visual impact that is similar to that of hair extensions or of hair decorations in long, flowing or braided hair.

Still further, by providing pendants and ornaments that are removeable on the sections of strands one may use a few pendants or ornaments to vary the appearance and effect achieved while wearing the device.

It is contemplated that the sections of strands may be made of decorative chain, such as chain of a precious metal. However it is also contemplated that the sections of strands incorporate at least one string of beads. Thus, since the strands may be made removeable, the wearer may vary the design by using various strands to the appearance of the ornamental device.

In a preferred embodiment the means for attaching to the device to the wearer's garment includes a pin for insertion through the garment. The pin should preferably include a safety pin configuration or a catch like those used on broaches and the like. However, it is also contemplated that the means for attaching the device to the wearer's garment include a spring loaded catch having an arm that pinches the garment between the arm and against the means for attaching the device to the garment. Still further, the invention may be used in cooperation with mating sections of hook and loop material to keep the means for attaching at a desired position relative to the back of the garment. Thus it will become apparent that one may attach the ornamental device to the garment before putting the garment on. This will allow the user to ensure that the device is properly centered and that it will remain properly centered while the ornamental device is being worn. This new, useful result was not achievable with necklaces or the like, which can wander or drift around the user's neck in an orbital fashion.

Also, by providing a means for attaching the device to back area near the neck or collar area of the wearer's garment, one may also include further ornamentation on the means for attaching the device to the garment. Thus, by incorporating a pin or broach with additional ornamentation that drapes over the back of the garment one can achieve ornamentation of the back of the garment, which is a new useful result that was unachieveable with the known prior art.

Thus it will become apparent that another aspect of the instant invention includes a method for decorating an upper chest area of an individual wearing a garment, where the garment has a back portion with a collar or neck-line portion. This method preferably will include the following steps:

a) providing a securement means for securely attaching the ornamental device to the wearer's garment. The securement means should preferably have an ear or the like for removably attaching the sections of strand and may itself include ornamentation;

b) providing a pair of sections or strands, the sections of strands being of a weight and being attachable to the securement means;

c) providing at least two ornaments that are attachable to the sections of strands and having a weight;

d) attaching the ornaments to the second end of each of the sections of strand;

e) attaching the securement means for attaching to the wearer's garment near the neck-line portion of the back portion of the garment; and f) draping the ornaments over the wearer's chest area, so that the weight of the ornaments retains the ornaments over the wearer's chest area.

Thus it can be appreciated that the disclosed invention provides advantages in versatility, use, and manner of decorating that were unachieveable by the known prior art.

Also, it will be appreciated that disclosed invention will draw attention to the head and face of the wearer.

While these and other advantages and objects of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
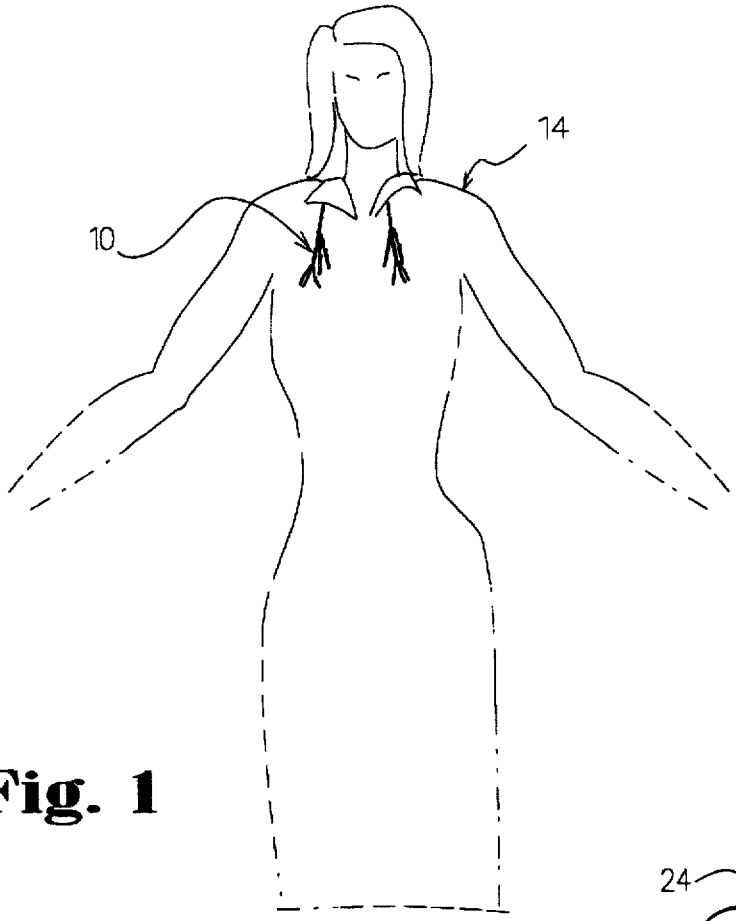
FIG. 1 is an illustration of the clothing ornamentation device in use.

Turning now to FIG. 1 where the silhouette of a person has been illustrated wearing a clothing ornamentation device 10 for decorating the upper torso area of an individual wearing a garment. As can be appreciated from FIG. 1 the ornamental device 10 is designed to provide a flowing appearance as if the wearer were using a decorative device like hair decorations, prominent earrings, or other ornamentation that draws attention to the upper torso, and particularly to the head and face areas of the wearer.

Figure 2A:
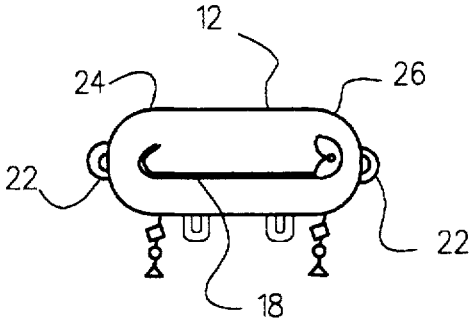
FIG. 2A is an enlarged view of an embodiment of the securement means.
Figure 2:
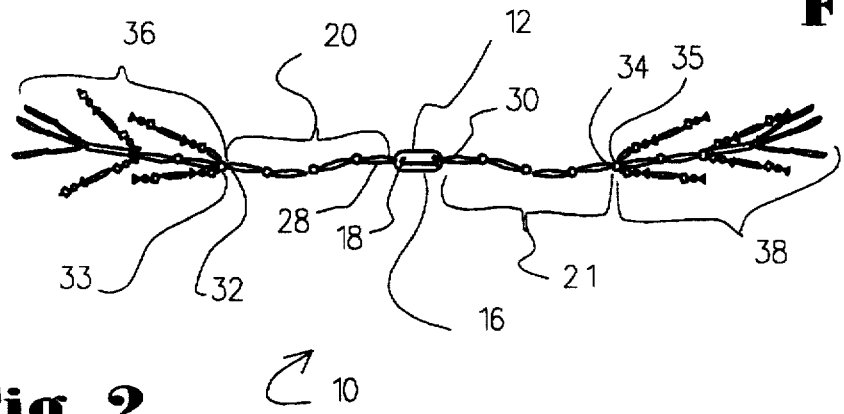
FIG. 2 shows a preferred embodiment of the device.

Referring now to FIGS. 2 and 2A, it has been illustrated that the ornamental device 10 includes a securement means 12 for attaching the clothing ornamentation device 10 to a wearer's garment 14. The securement means 12 includes a body 16, which includes an attachment means 18. As shown on FIG. 2A, the attachment means on a preferred embodiment is a safety-pin type device, as is commonly found in many broaches or other pendants. However, it should be noted that while the preferred embodiment has been shown having safety-pin type configuration it is contemplated that other devices, particularly devices that clamp the fabric of the garment, may also be used. Furthermore, it is contemplated that mating sections of hook and loop material may be used by attaching one section to the back of the garment and the other section to the body 16.

On the securement means 12, and preferably on the body 16 of the securement means 12, is a means for attaching at least one strand, which has been shown to include a first section of strand 20 and a second section of strand 21. The preferred embodiment of the invention includes two separate sections of strand 20 and 21. However it is contemplated that the advantages taught herein may be achieved by attaching a single, long section of strand to the body of the securement means in a manner that produces two sections of strand of substantially equal length. Thus once the single section of strand is attached to the securement means so that the bifurcation of the strand defines the first section of strand 20 and the second section of strand 21, without actually having two separate sections of strand.

Thus when making the preferred embodiment of the invention, the body 16 of the securement means 12 will preferably include means for attaching the section of strand to the securement means 12. It is contemplated that these means for attaching the section of strand is preferably a loop shaped ear 22, a lug type protrusion, or one of many well known devices for attaching a flexible strand to another piece of jewelry.

In the preferred embodiment shown on FIG. 2A, the body 16 of the securement means 12 has a first end 24 and a second end 26. The first end 24 of the securement means 12 includes a first means for attaching a section of strand, and similarly, the second end 26 of the securement means 12 also includes a means for attaching a section of strand. It is important to note that while the preferred embodiment is shown having two separate sections of strands, it is contemplated that the a single long section of strand may be attached to the body 16 in a manner that substantially bisects the single long strand to define two sections of strand. It is contemplated that the means for attaching strand to the body 16 may also be a simple ear, jewelry catch, or lugs as commonly used for attaching sections of jewelry together.

Also shown on FIG. 2 is an embodiment of the clothing ornamentation device 10 which includes at two separate sections of strands attached to the body 16 of the securement means 12. It is contemplated that the attachment of these strands to the body 16 may also be accomplished by means of catches or other devices that allow removeable attachment of the strands to the body. Thus the first section of strand 20 and the second section of strand 21 attach at opposite ends of the body 16 of the securement means permanently or removably so that the user may vary the ornamentation and decorative design of the device.

Also, it is important to note that by attaching the securement means 12 to garment, the securement means 12 may also serve as support for additional ornamentation that allows decoration of the back of the wearer's garment. This ornamentation of the securement means may take form as fixed ornaments on the securement means itself, or as pendants or other dangling ornaments which may serve to decorate the back of the user's garment.

The sections of strand 20 and 21 are preferably a string of a beads, a section of jewelry chain, a strip of leather or another flexible section of strand material. Thus, the preferred configuration of each section of strand includes strands that have a longitudinal body with a first end and a second end. The first end 28 of the first section of strand 20 includes means for attaching the end 28 to the body 16 of the securement means 12. Similarly, the first end 30 of the second section of strand 21 also includes means for attaching the end 30 to the body 16 of the securement means 12. The second end 32 of the first section of strand 20 includes means for attaching at least one ornamentation. Similarly, the second end 34 of the second section of strand 20 also includes means 33 for attaching at least one ornamentation. The means for attaching at least one ornamentation may be one of many well known devices for permanently or removably attaching sections of jewelry together. This includes miniature clasps, resilient rings, links, hooks, and the like.

Similarly, the second end 34 of the second section of strand 20 also includes means 35 for attaching at least one ornamentation. Attachable to the means 35 for attaching at least one ornamentation on the second end 32 of the first section of strand 20 is a first ornament 36. The first ornament 36 also includes means for attaching the ornament to the second end 32 of the first section of strand 20. It is important to note that the first ornament 36 is of a weight that when added to the weight of the first section of strand 20, the combined weights allow the ornament 36 to drape at the desired position over the user's body while wearing the ornamental device 10. Thus, this weight distribution, in addition to flexibility of the strands, allows the user to achieve the aesthetic and ornamental advantages of the draping of the ornamental device 10 over the user's upper chest area while being supported by the section of strands.

In order to achieve a balanced appearance and weight distribution, a second ornament 38 having means for attaching to the second end 34 of the second section of strand 21 is also provided. The second ornament 38 will preferably be of a weight that is greater than the weight of the second section of strand 21, so that the second ornamentation 38 may be draped over the user's upper chest area while being supported by the second section of strand 21, as shown on FIGS. 4–6. As explained above, the weight of the second ornament 38, like the weight of the first ornament 36, will keep the second ornament 38 positioned over the wearer's upper torso area.

The attachment means used to attach the first ornament 36 to the second end 32 of the first section of strand 20, as well as the second ornament 38 to the second end 34 of the second section of strand 21 may be a permanent linkage. However a releasable means of the type commonly used to join sections of jewelry together may also be used to achieve interchangeability and versatility. These releasable means may include clasps, resilient rings or the like commonly used to join sections of jewelry.

Also, it is important to note that, as used herein and in the appended claims, the reference to the second end of the sections of strand includes areas near the second end of the second section of strand. Therefore, it is contemplated that an ornament may simply branch from the first section of strand 20 or the second section of strand 21, near the second end 32 first section of strand 20 or the second end 34 of the second section of strand 21. It is important, however, that the ornamentation be included in order to create a weight bias on the sections of strand.

Figure 3:
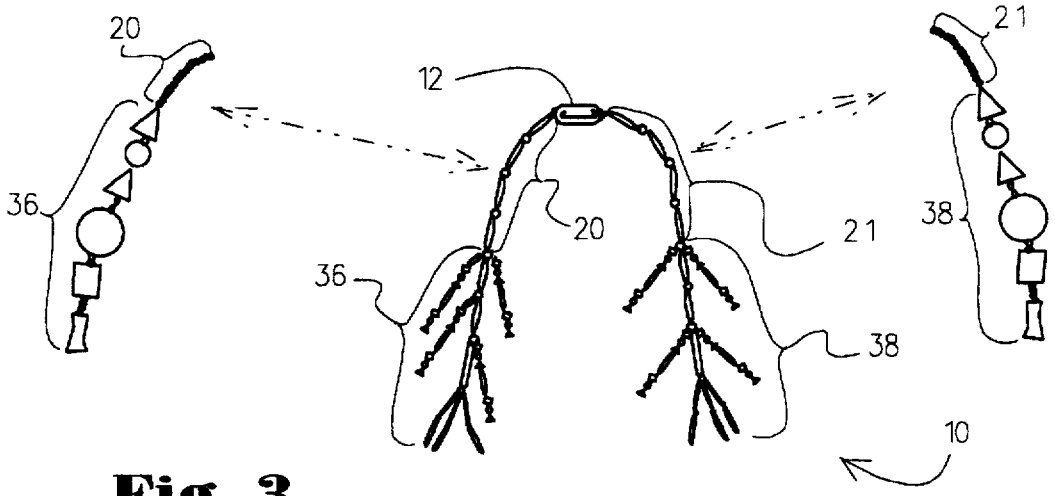
FIG. 3 is a view illustrating the interchangeability of components of the invention.

Turning now to FIG. 3, where is shown that it is contemplated that the ornamental device 10 may be used with a first ornament 36 and a second ornament 38, each made from string of beads or other decorative elements, such as precious or semi-precious stones. Also shown on FIG. 3 is another important aspect of the instant invention, the aspect being that by being able to provide separateable sections, such as the first ornament 36 and the second ornament 38, the user will be able to modify or customize the ornamental device 10 by adding more ornaments or varying the ornaments used.

Thus, it is also clear that another aspect of the instant invention includes a method for decorating an upper chest area of an individual who is wearing a garment that has a back portion having a neck opening. The method includes providing the securement means, such as the securement means 12, that may be securely attached to the wearer's garment near the neck opening. Then providing a first section of strand 20 and a second section of strand 21 and attaching the strands to the means for removably attaching section of strands on the securement means 12.

The process is followed by providing the first ornament 36 and the second ornament 38, which have means for attaching to the ornaments to the strands. Then attaching the first ornament 36 to the second end 32 first section of strand 20 and attaching the second ornament 38 to the second end 34 of the second section of strand 21. This assembly is then ready to be attached to the wearer's garment near the collar or neck opening portion of the garment by means of the securement means 12.

Figure 4:
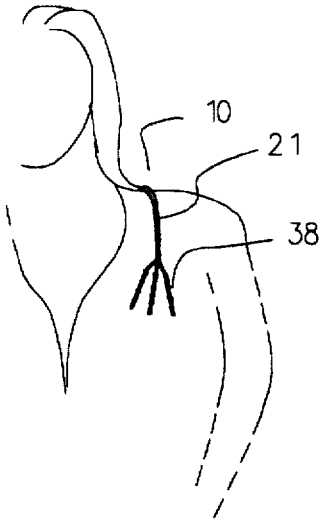
FIG. 4 illustrates the draping and placement on the user's upper torso area achieved with the instant invention.
Figure 5:
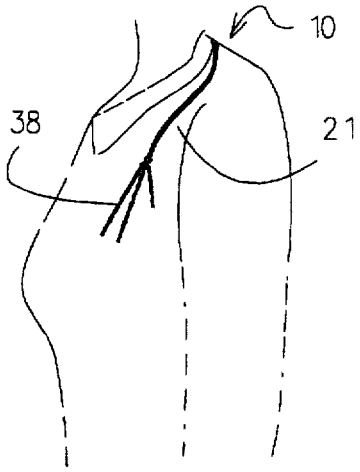
FIG. 5 is a side view of the placement and draping of the invention on the user's upper torso area.
Figure 6:
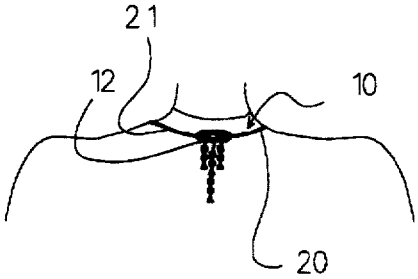
FIG. 6 is a view of the back of the wearer; the view illustrating attachment of the device to the back of the user's garment and the draping effect over the wearer's upper shoulder area.

As shown on FIGS. 4–6, the process may be followed by then draping the first ornament 36 and the second ornament 38 over the wearer's chest area, so that the weight of the ornaments 36 and 38 retain the ornaments over the wearer's chest area.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A clothing ornamentation device for decorating the upper torso area of an individual wearing a garment, the device comprising:

securement means for attaching to the wearer's garment, the securement means having means for attaching a strand;

a strand having:

a first section of strand, the first section of strand having a first end and a second end and a weight, the first end being connected to the means for attaching a section of strand of said securement means the second end having means for attaching at least one ornamentation;

a second section of strand, the second section of strand having a first end, a second end and a weight, the first end being connected to the means for attaching a section of strand of said securement means the second end having means for attaching at least one ornamentation;

a first ornament attached to the second end of the first section of strand, the first ornament having a weight that adds to the weight of the first section of strand so that the ornamentation may be draped over the user's upper chest area while being supported by the first section of strand; and a second ornament attached to the second end of the second section of strand, the second ornament having a weight that adds to the weight of the second section of strand so that the ornamentation may be draped over the user's upper chest area while being supported by the first section of strand.

2. A device according to claim 1 and further comprising means for releasably attaching said first ornament to the second end of the first section of strand.

3. A device according to claim 2 and further comprising means for releasably attaching said second ornament to the second end of the second section of strand.

4. A device according to claim 3 wherein said securement means comprises attachment means having clasping means for gripping the garment.

5. A device according to claim 3 wherein said securement means comprises attachment means having a pin for insertion through the garment.

6. A clothing ornamentation device for decorating the upper torso area of an individual wearing a garment, the garment having a back portion having a neck opening, the device comprising:

securement means for attaching the device near the neck opening on the back portion of to the wearer's garment and retaining the position of the device relative to the wearer's garment, the securement means having means for attaching a first section of strand and a second section of strand;

a pair of sections of strands, each section of strand having a first end and a second end and a weight, the first end being attachable to said securement means the second end having means for attaching at least one ornamentation;

a first ornament having means for attaching to the second end of the first section of strand, the first ornament having a weight that is greater than the weight of the first section of strand, so that the ornamentation may be draped over the user's upper chest area while being supported by the first section of strand; and a second ornament having means for attaching to the second end of the second section of strand, the second ornament having a weight that is greater than the weight of the second section of strand, so that the ornamentation may be draped over the user's upper chest area while being supported by the first section of strand.

7. A device according to claim 6 wherein said first section of strand is releasably attachable to said securement means.

8. A device according to claim 7 wherein said second section of strand is releasably attachable to said securement means.

9. A device according to claim 8 wherein the means for attaching said first ornament to the second end of the first section of strand is releasable.

10. A device according to claim 9 wherein the means for attaching said second ornament to the second end of the second section of strand is releasable.

11. A method for decorating an upper chest area of an individual wearing a garment, the garment having a back portion having a collar portion, the method comprising:

providing a securement means for attaching to the wearer's garment, the securement means having a first and a second end, the first end having a means for attaching a first section of strand and the second end having means for attaching a second section of strand;

providing a first section of strand, the first section of strand having a first end and a second end and a weight, the first end being attachable to the means for attaching a first section of strand of said securement means the second end having means for attaching at least one ornamentation;

providing a second section of strand, the second section of strand having a first end and a second end and a weight, the first end being attachable to the means for attaching a second section of strand of said securement means the second end having means for attaching at least one ornamentation;

attaching the first end of the first section of strand to the means for attaching a first section of strand of said securement means;

attaching the first end of the second section of strand to the means for attaching a second section of strand of said securement means;

providing a first ornament having means for attaching to the second end of the first section of strand, the first ornament having a weight that is greater than the weight of the first section of strand;

attaching the first ornament to the second end of the first section of strand;

providing a second ornament having means for attaching to the second end of the second section of strand, the second ornament having a weight that is greater than the weight of the second section of strand;

attaching the second ornament to the second end of the second section of strand;

attaching the securement means for attaching to the wearer's garment near the collar portion of the back portion of the garment;

draping the first ornament over the wearer's chest area, so that the weight of the first ornament retains the first ornament over the wearer's chest area;

draping the second ornament over the wearer's chest area, so that the weight of the second ornament retains the second ornament over the wearer's chest area.

* * * * *